US005616004A

United States Patent [19]

Alizadeh

[11] Patent Number: 5,616,004

[45] Date of Patent: Apr. 1, 1997

[54] AXIAL FLOW FAN

[75] Inventor: Ahmad Alizadeh, Indianapolis, Ind.

[73] Assignee: Valeo Thermique Moteur, Le-Mesnil Saint Denis, France

[21] Appl. No.: 425,991

[22] Filed: Apr. 19, 1995

[51] Int. Cl.[6] ..... F04D 29/30

[52] U.S. Cl. ..... 416/238; 416/169 A; 415/119; 415/191; 415/208.1; 415/211.2

[58] Field of Search ..... 416/169 A, 189, 416/223 R, 238, 243; 415/119, 183, 191, 208.1, 211.2

[56] References Cited

U.S. PATENT DOCUMENTS

| | | | |
|---|---|---|---|
| 3,173,490 | 3/1965 | Stuart III | 416/223 R |
| 4,046,489 | 9/1977 | Fairchild et al. | 416/169 A |
| 4,568,242 | 2/1986 | Susa et al. | 416/169 A |
| 4,915,588 | 4/1990 | Brackett | 416/189 |
| 4,971,520 | 11/1990 | Van Houten | 416/169 A |
| 5,184,938 | 2/1993 | Harmsen | 415/119 |
| 5,312,230 | 5/1994 | Oda et al. | 416/169 A |
| 5,466,120 | 11/1995 | Takeuchi et al. | 415/119 |

FOREIGN PATENT DOCUMENTS

| | | | |
|---|---|---|---|
| 0123712 | 9/1979 | Japan | 415/119 |
| 0009698 | 1/1988 | Japan | 415/211.2 |
| 0185497 | 7/1994 | Japan | 415/119 |

*Primary Examiner*—Edward K. Look
*Assistant Examiner*—Christopher Verdier
*Attorney, Agent, or Firm*—Morgan & Finnegan, LLP

[57] ABSTRACT

An axial flow fan has a hub with a back plane that is perpendicular to the axis of hub rotation. The leading and trailing edges of the fan blades that bound the inner region of the respective blades are in general radial alignment with the hub. The leading portion of the tip region is swept forward relative to the back plane and the trailing portion of the tip region is swept in the opposite direction. The forward swept tip region forms an acute angle with the back plane.

17 Claims, 20 Drawing Sheets

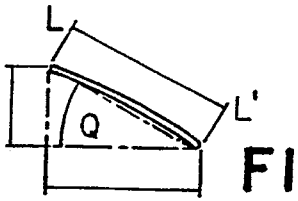
FIG. 6I
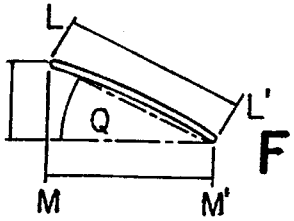
FIG. 6II
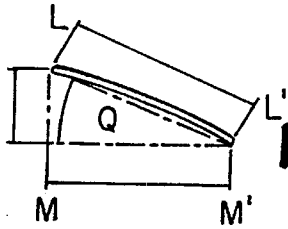
FIG. 6III
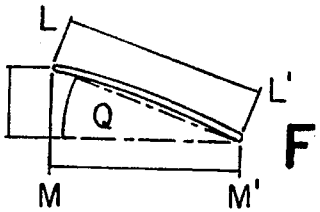
FIG. 6IV
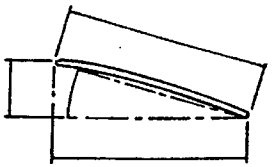
FIG. 6V
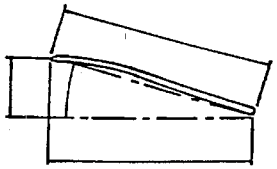
FIG. 6VI
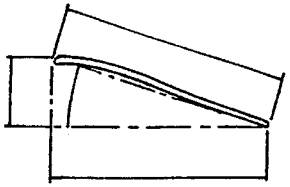
FIG. 6VII
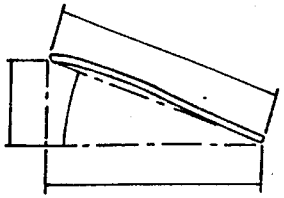
FIG. 6VIII

AXIAL FLOW FAN

FIELD OF THE INVENTION

The present invention relates to an axial flow fan, and more particularly to an axial flow fan suitable for use in association with a heat exchanger in a motor vehicle cooling system.

BACKGROUND TO THE INVENTION

Axial flow fans are well known in the art and conventionally consist of a number of blades supported by a central hub member, the blades being disposed regularly about the hub member. Some axial flow fans have a blade support linking together the tips of the blades, the blade support being an annular band. An especially important feature of axial flow fans in the context of vehicle cooling systems is the acoustic performance of the fans. Specifically, it is desirable to produce the quietest fans possible while at the same time providing both high efficiency and compact design.

A prior art patent, U.S. Pat. No. 5,312,230 discloses an axial flow fan aimed at improving efficiency by reducing the stagnant flow at the root of the blade. This prior patent uses arc-section blades having increased bending ratios as hereinafter defined in the root region.

The present invention seeks to reduce acoustic losses and thus to provide both improved noise performance and efficiency.

SUMMARY OF THE INVENTION

According to a first aspect of the present invention there is provided an axial flow fan having plural blades secured to a hub portion, each blade having a leading edge, a trailing edge and a radially-inner region extending to a tip region, wherein a leading portion of the tip region is swept relative to the radially-inner region in a first direction with respect to a plane perpendicular to the axis of rotation of the fan and a trailing portion of the tip region is swept relative to the radially-inner region in a second opposite direction with respect to the plane.

Preferably the leading portion of the tip region is swept upwardly so as to be relatively further from the plane than the leading edge of the radially inner region.

Advantageously the sweep of the tip region is neutral at the medial line of the tip region.

Conveniently the radially inner region has an arc shaped cross-section, taken along a blade circumferential line, such that the bending ratio, defined as ratio of the maximum deviation from the chord at the circumferential line to the length of the chord, decreases over the radially innermost portion of the radially inner region of each blade, and then increases over a radially adjacent portion of the radially inner region.

Preferably the bending ratio varies along the span of the radially inner region substantially symmetrically about a radial mid-point of the radially inner region.

Advantageously the bending ratio in the radially inner region is lowest at the the mid point.

Preferably the maximum value of bending ratio along the total blade span is 4% or less.

Conveniently the leading edge of the radially inner region is more distant from the plane than the trailing edge of the region.

Advantageously the leading portion of the tip region is forwardly skewed with respect to the direction of rotation of the fan.

According to a second aspect of the present invention there is provided an axial flow fan in accordance with the first aspect of the present invention in combination with a fan shroud member defining a substantially circular aperture, and a fan mounting device for mounting the fan within the circular aperture, the fan mounting device comprising a prime number of arm members extending from the shroud member into the circular aperture.

BRIEF DESCRIPTION OF THE DRAWINGS

A preferred embodiment of the invention will now be described by way of example, with reference to the accompanying drawings in which:

FIGS. 6(*i*)–6(*viii*) each show a respective section across the blade of FIG. 4 taken respectively along lines I—I to VIII—VIII of FIG. 4.

FIG. 9 shows the work distribution along the blade span.

FIG. 10 shows the variation in Reynolds number along the blade span.

FIG. 11 shows the lift distribution along the blade span.

FIG. 12 shows the variation in deviation angle along the blade span.

FIG. 13 shows the variation in chord distribution along the blade span.

FIG. 14 shows the variation in solidity distribution along the blade span.

FIG. 15 shows the variation in pitch distribution along the blade span.

FIG. 16 shows the variation in camber distribution along the blade span.

In the figures, like reference numerals indicate like parts.

DESCRIPTION OF THE PREFERRED EMBODIMENT

Figure 1:
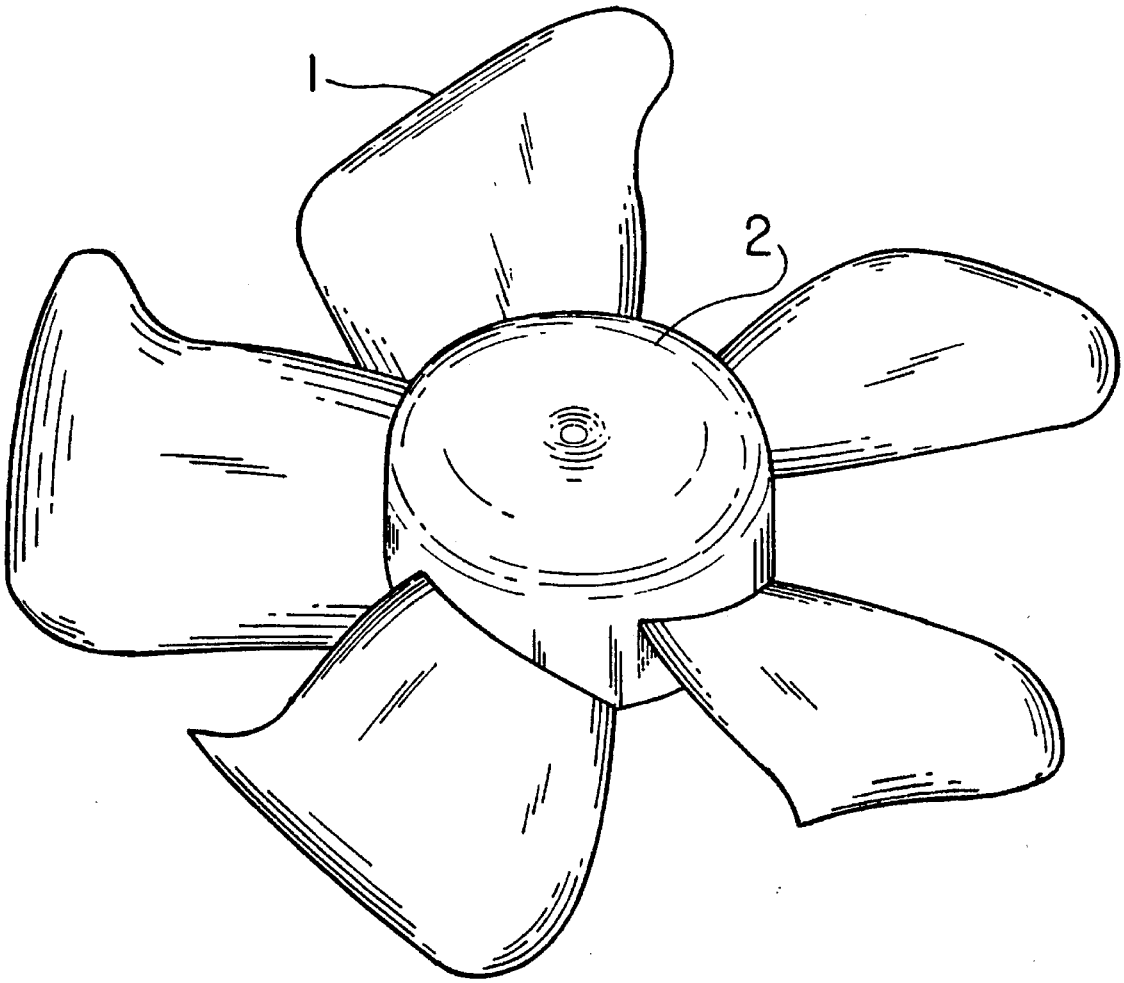
FIG. 1 shows a perspective view of an embodiment of a fan in accordance with the present invention.

FIG. 1 shows a perspective view of an embodiment of a fan in accordance with the invention. Referring to FIG. 1, the fan has five blades (1), each secured at a respective root region to a generally bowl-shaped hub portion (2). In the presently described embodiment, the tip regions of the blades are not interconnected by a blade support member, but it will of course be understood by one skilled in the art that such a blade support member, typically in the form of a cylindrical ring coaxial with the fan axis could be provided.

Figure 2:
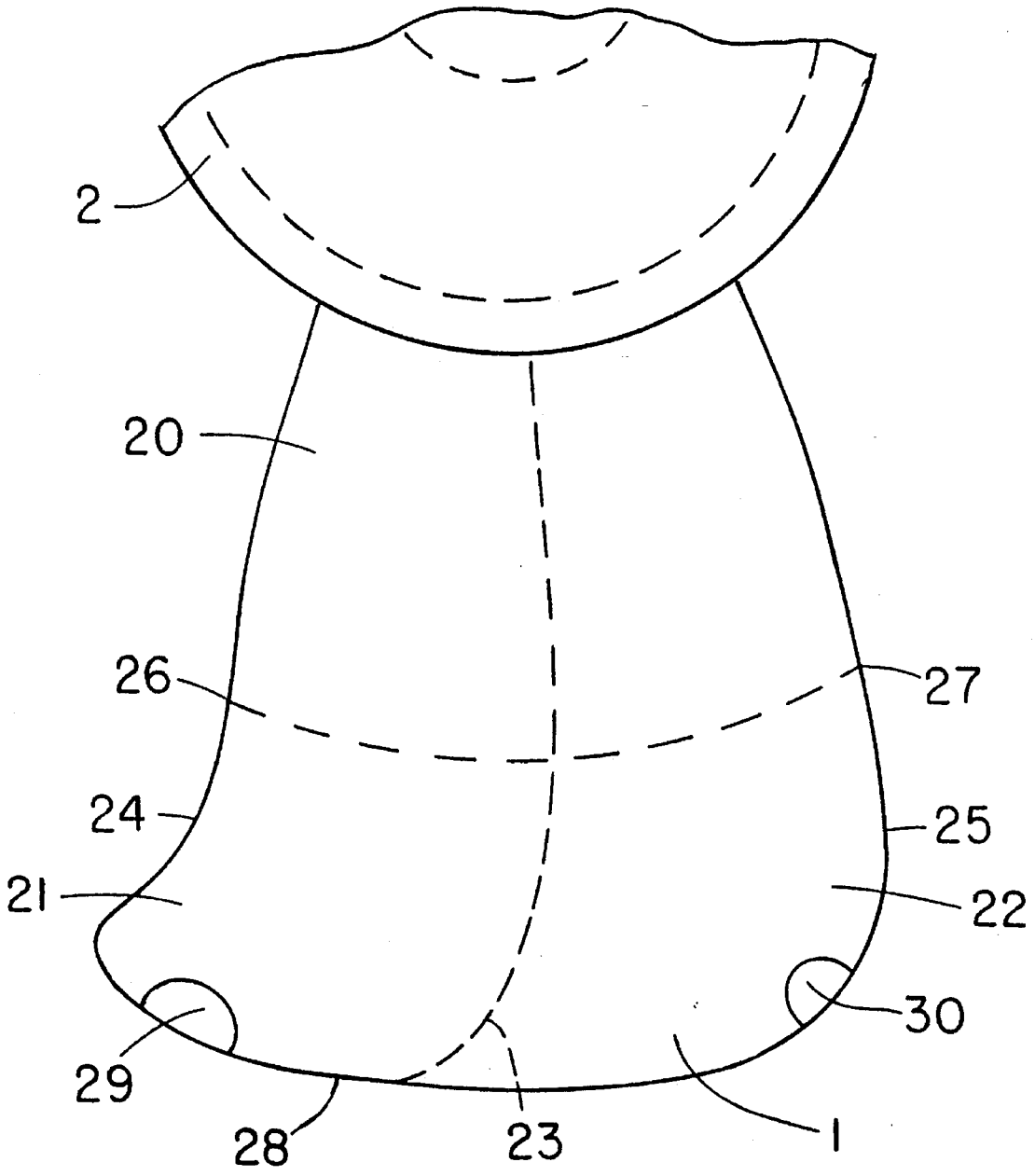
FIG. 2 shows a plan view of a blade of the fan of FIG. 1.

Referring now to FIG. 2, the blade (1) has a first radially-inner region (20) which, in the embodiment described, has a slightly arc-shaped cross-section. Slightly arc-shaped means that the bending ratio, in other words the ratio of the maximum perpendicular deviation from the chord to the length of the chord, is 4% or less. In the presently-described embodiment, the chord angle, the angle between the blade chord and the plane perpendicular to the axis of the fan is positive in that the leading edge (24) of the blade is higher than the trailing edge (25) of the blade. This will be more clearly described with respect to FIGS. 6(*i*)–(*viii*).

The blade further has two tip regions, (21,22) which meet one another along a medial contour line (23), and which extend from the radially-outer extremity (26–27) of inner region (20). Tip region (21) is bounded on one side by the blade leading edge (24) and is referred to as the leading tip region, whereas tip region (22) which is bounded on one side by the trailing edge (25) is referred to as the trailing tip region. To provide the acoustically-advantageous properties of the present blade, the leading tip region is upwardly swept, and the trailing tip region is downwardly swept. More specifically, the leading edge (24) of the radially-inner region (20) remains substantially constantly spaced from a hub back-plane through the rear of the hub and perpendicular to the fan axis. The trailing edge (25) of the radially-inner region likewise is at a substantially constant, although substantially smaller spacing from the back-plane. From a point (26) representing.the radially outward extremity of the inner region (20), the spacing of the leading edge (24) to the back-plane increases relatively sharply. The leading edge (24) curves into the blade outer edge (28) and the "highest point" of the fan, in other words the point on the blade of maximum spacing from the above-mentioned back-plane is located generally within a region shown as 29 on FIG. 2.

Likewise from a point (27) along the trailing edge corresponding to the radially-outward extremity of inner region (20), the trailing edge drops towards the above-mentioned plane reaching a "lowest height", in other words a position where the blade is at its closest to the above-mentioned plane, in a zone (30).

Figure 3:
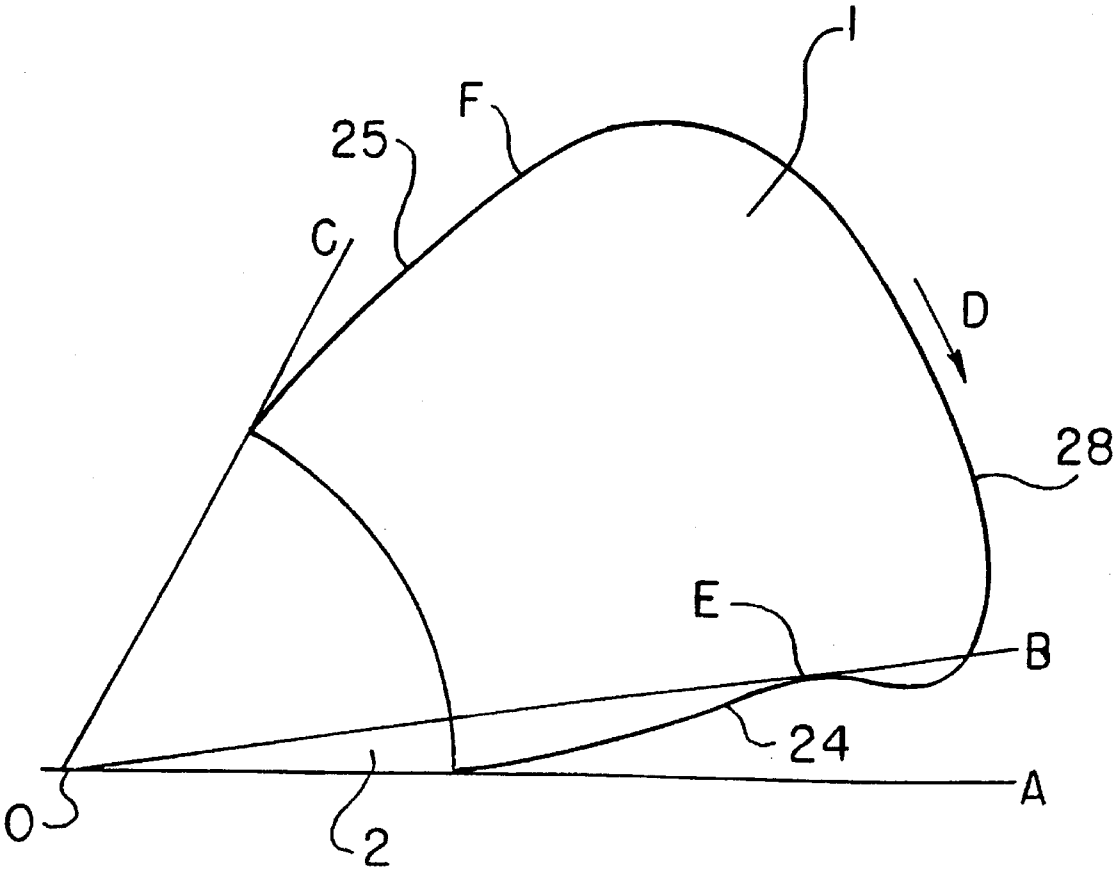
FIG. 3 shows the orientation of the blade of FIG. 2 with respect to fan radii.

Referring now to FIG. 3, the orientation of the blade with respect to the centre of the fan and the direction of rotation will now be described:

FIG. 3 shows the axis O of the fan, together with three fan radii fan OA, OB and OC. The radius OA passes through the point at which the leading edge (24) of the blade (1) meets the hub (2). As will be seen from FIG. 3, the leading edge (24) is skewed rearwardly from the radius OA, with respect to the direction of rotation shown by arrow D.

The radius OB passes through the rearmost point E of the leading edge (24), and it will be seen that the point E represents the point of inflection between the radially-inner rearwardly skewed portion of the leading edge and a radially-outer forwardly skewed portion of the leading edge. However, after an initial forward skew in the radially-outer portion of the leading edge, the leading edge then curves sharply rearward in a transition curve into the outer edge (28).

Radius OC intersects the hub at the point where the trailing edge (25) meets the hub. As will once again be seen in FIG. 3, the trailing edge (25) is forwardly skewed with respect to the direction of rotation D. At a point F on the trailing edge (25) the trailing edge begins a forward transition curve into the outer edge (28). The radial distance OE to the point of inflection of the trailing edge is approximately the same as the radial distance OF to the point at which the trailing edge starts the above-mentioned transition curve. The leading edge (24) is curved slightly rearwardly between the root and point E, and the trailing edge is curved slightly forwardly between the root and the transition point F.

Figure 4:
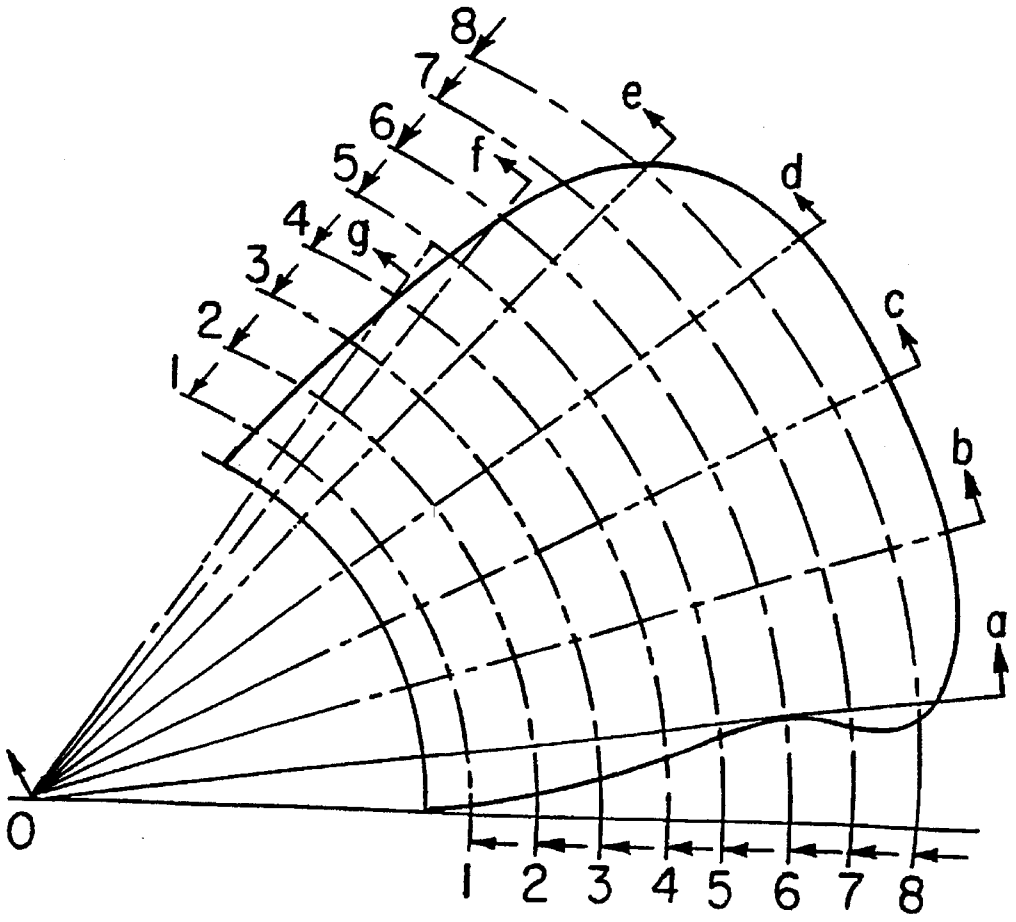
FIG. 4 shows the blade of FIG. 2 and the section lines for FIGS. 5 and 6.
Figure 5A:
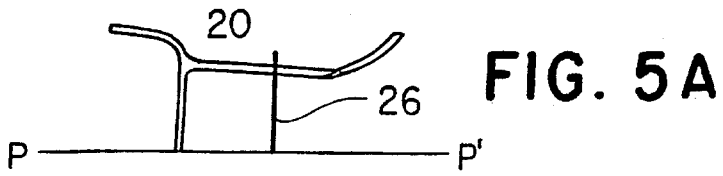
FIGS. 5(*a*)–5(*g*) each show a respective section through the blade of FIG. 4 taken respectively along lines Oa to Og of FIG. 4.
Figure 5B:
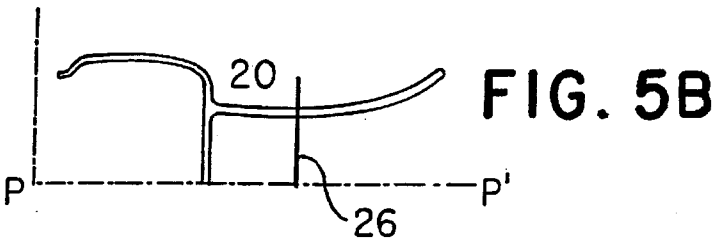
Figure 5C:
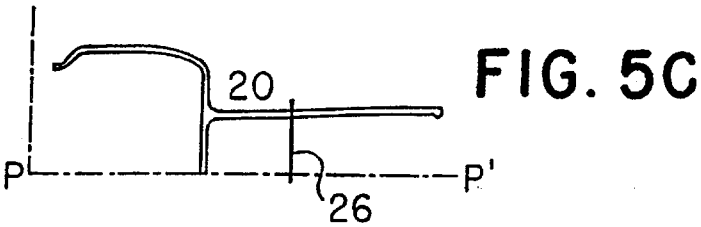
Figure 5D:
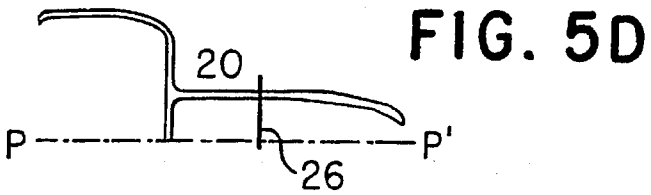
Figure 5E:
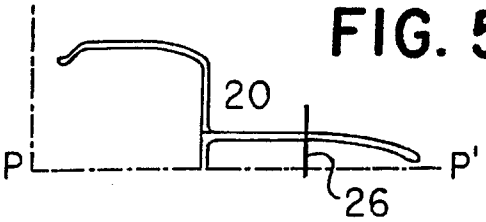
Figure 5F:
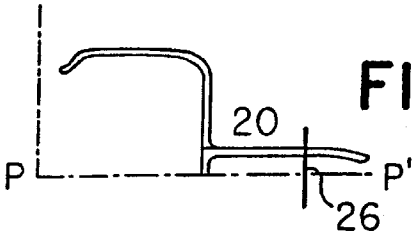
Figure 5G:
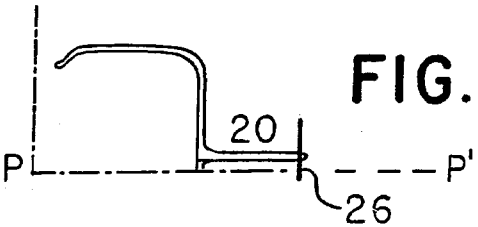

The actual shape of the blade (1) will now be further described with respect to FIGS. 4, 5(*a*)–(*g*) and FIGS. 6(*i*)–(*viii*).

FIG. 4 shows blade (1) with a number of section lines taken along respective radii Oa-Of, and a second plurality of sections taken around respective fan sectors I–I' to VII-I–VIII'.

Referring to FIGS. 5(*a*)–(*g*), it will be seen that the longitudinal cross sections through the blade (1) each have a generally flat portion starting from the root of the blade for a distance corresponding to the extent of the radially inner region (20), described previously with reference to FIG. 2. The cross section of FIG. 5(*a*) is taken close to the leading edge, as will be seen with reference to FIG. 4, and the blade is at its "highest" at the leading edge—in other words the spacing from the back plane P–P' of the hub is at its greatest. Inspection of FIGS. 5(*a*)–(*g*) shows that the blade overall gets continually "lower" as the sections proceed from the leading edge to the trailing edge i.e. approaches the back plane P–P' As can be most clearly seen in FIGS. 5(*a*) and 5(*b*), the tip region of the blade is upwardly swept away from the plane P–P' at the leading edge and is downwardly swept towards the plane P–P' towards the trailing edge. Only a small downward sweep is shown on FIG. 5(*f*) because the above-discussed transition curve produces a foreshortened blade length along this radius. The section 5(*c*) is taken along a radius which corresponds generally to the straight line portion of the medial contour (23), described with respect to FIG. 2. Reference to FIG. 2 shows that the medial contour line (23) becomes forwardly skewed close to the blade tip and thus the end portion of FIG. 5(*c*) shows a slight downturn.

Turning now to FIG. 6(*i–viii*), the sections shown are around the respective circumferences of sectors I—I to VIII—VIII. Thus inspection of FIG. 6(*i*)–(*viii*) shows that the actual length L–L' between the blade leading edge and the blade trailing edge increases along the span of the blade and that the projected length M–M' likewise increases along the blade span. However the chord angle Q between a line connecting the trailing and leading edges and the plane P–P' has a maximum value at the root portion and decreases along the span of the blade until the radial extremity (26) (FIG. 2) of the radially-inner portion (20). This corresponds to FIG. 6(*v*). After this, the angle Q increases up to the tip region.

Figure 7:
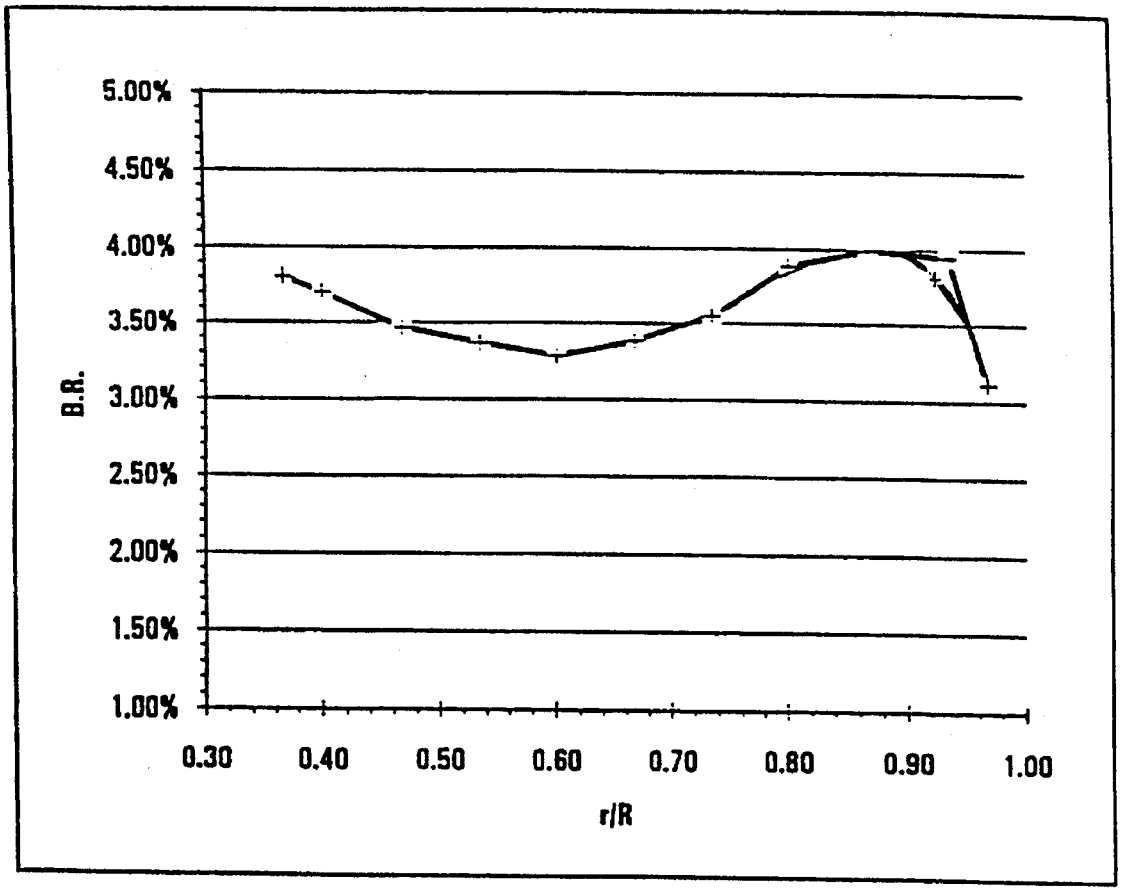
FIG. 7 shows the bending ratio of the blade of FIG. 4.

Referring to FIG. 7, the bending ratio of the blade (1) will now be described:

The bending ratio of a blade is defined as the ratio of the maximum perpendicular spacing of the blade from the blade chord, to the length of the blade cord. As will be seen from FIG. 7, the bending ratio of the blade of the embodiment is low—always equal to or less than 4%. Proceeding from the root portion of the blade towards the tip, the bending ratio falls over the first half of the radially inner region (20) and then rises again towards the radially outer extremity of the radially inner region (20). Specifically, the variation of the bending ratio along the span of the radially-inner region (20) is substantially symmetrical. In the radially outer part of the tip region, the bending ratio decreases rapidly.

A fundamental feature of the blade of the invention lies in the provision of a tip region having an upward sweep to one side of the medial line of the blade, and a downward sweep to the other side of the medial line. This sweep variation produces out of phase phenomena by which the noise radiated from the leading and trailing surfaces cancel one another out. In the inner region of the blade the bending ratio of the blade is small and the variation in bending ratio is itself small. Other values of bending ratio may however be provided. Specifically the bending ratio may vary asymmetrically along the inner-region of the blade and may have more than one peak and trough.

The described embodiment has an overall forward skew, as seen by the medial line (23) in FIG. 2. This however is a property of the embodiment concerned. Specifically the blade could be swept backwardly in either or both the inner and tip regions, the blade could be unskewed, in other words the medial line and the leading and trailing edges could be substantially radial, or the leading edge could be skewed one way and the trailing edge skewed the other way to produce a conical effect. Any other skew is also envisaged. Although the invention has been described with respect to a five bladed fan, this is likewise not essential to the invention. Other numbers of blades could be provided. Finally the solidity ratio of the fan could be substantially different to that shown.

Figure 8A:
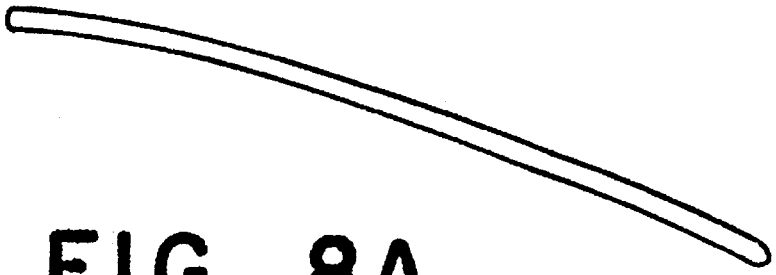
FIGS. 8(*a*)–(*c*) shows modified blade thicknesses for the blade of FIG. 4.
Figure 8B:
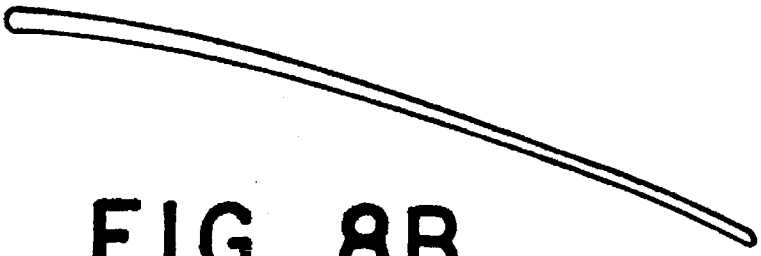
Figure 8C:
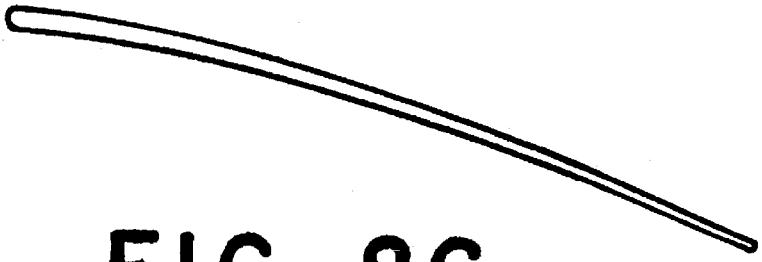

Turning to FIG. 8, the thickness of the blade could be varied between the leading edge and the trailing edge. Specifically as the radially outer part of the leading edge carries the highest load, the trailing edge of the blade can be made relatively thinner than the leading edge of the blade. This allows for a reduction in the overall mass and weight of the blade, and by virtue of this thickness reduction the so-called "wake" condition to the rear of the blade can be reduced and this leads to less boundary layer interaction between adjacent blades. As is known to those skilled in the art, the "wake" condition is a separation between the flow over the suction and pressure sides of the trailing edge of the blade which gives rise to undesirable noise. It is envisaged that the blade described could have a trailing edge thickness equal to or less than half the thickness of the blade at the leading edge.

Figure 9:
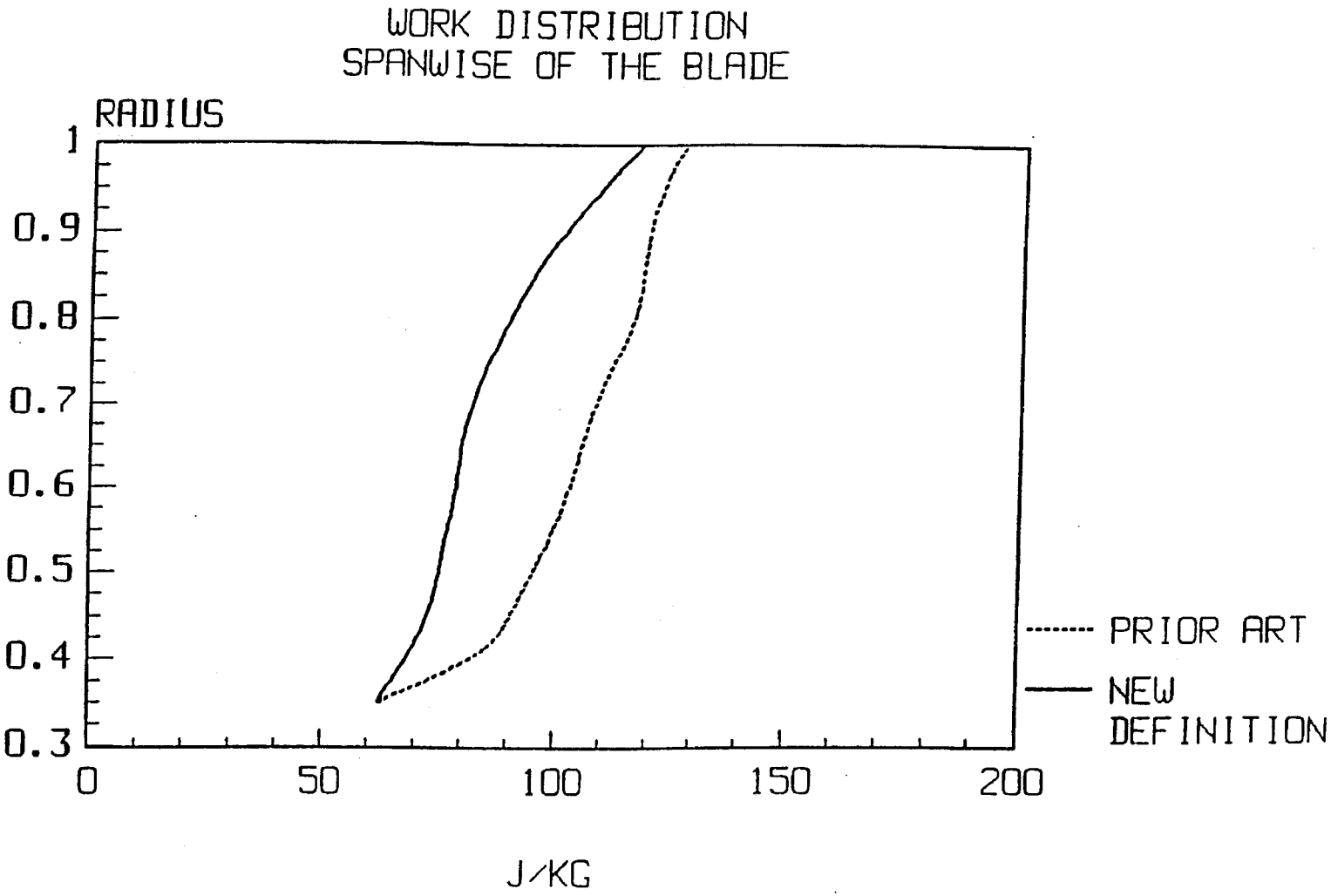
FIGS. 9–16 show properties of the fan of FIG. 1.
Figure 10:
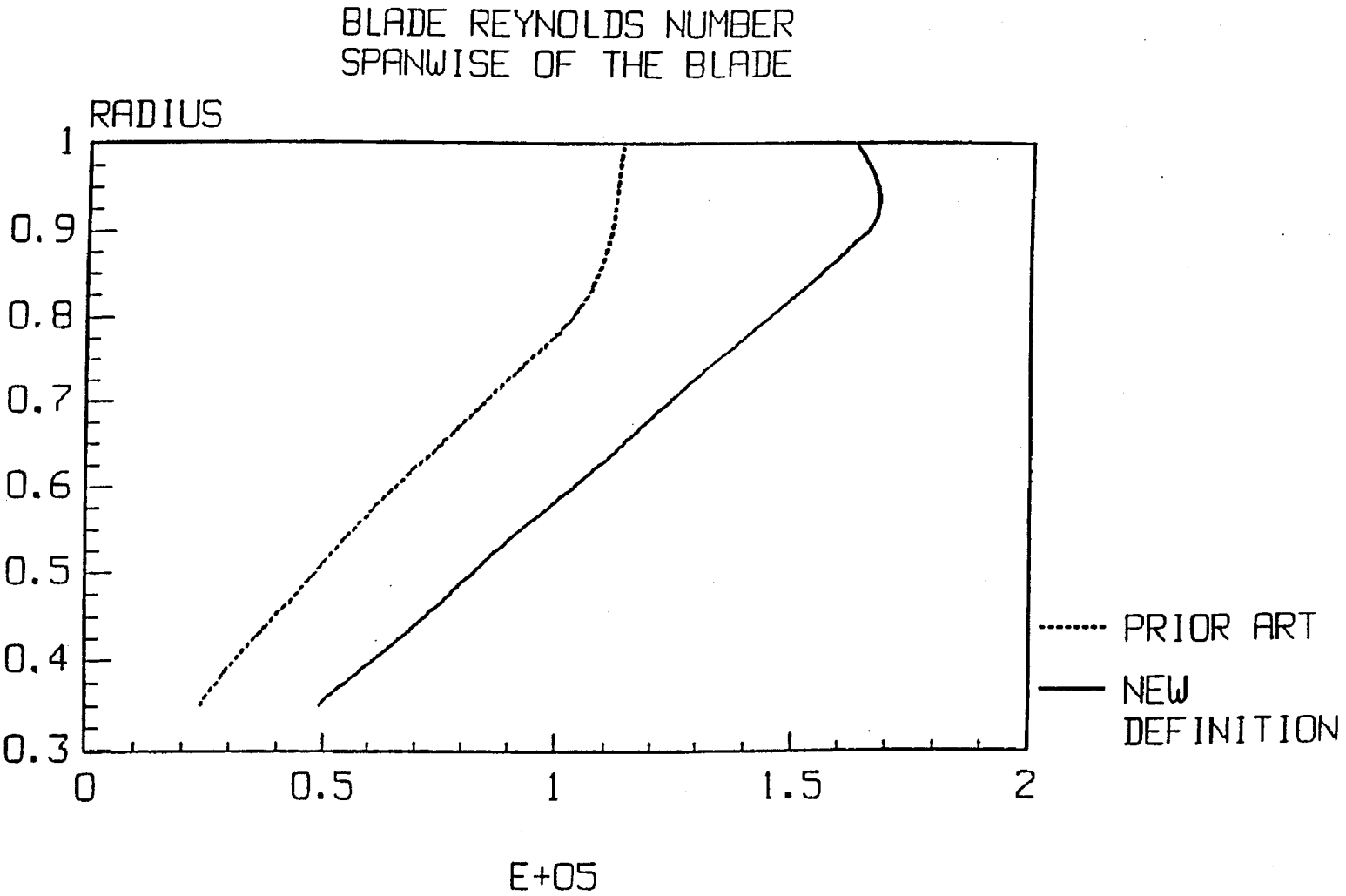

The fan of FIG. 1 has advantageous properties with respect to a conventionally axial flow fan. Referring to FIG. 9 it will be seen that the work distribution along the span of the blade is lower than the conventional fan, and more evenly distributed. Turning to FIG. 10, the Reynold's number of the blade is improved for all radii.

Figure 11:
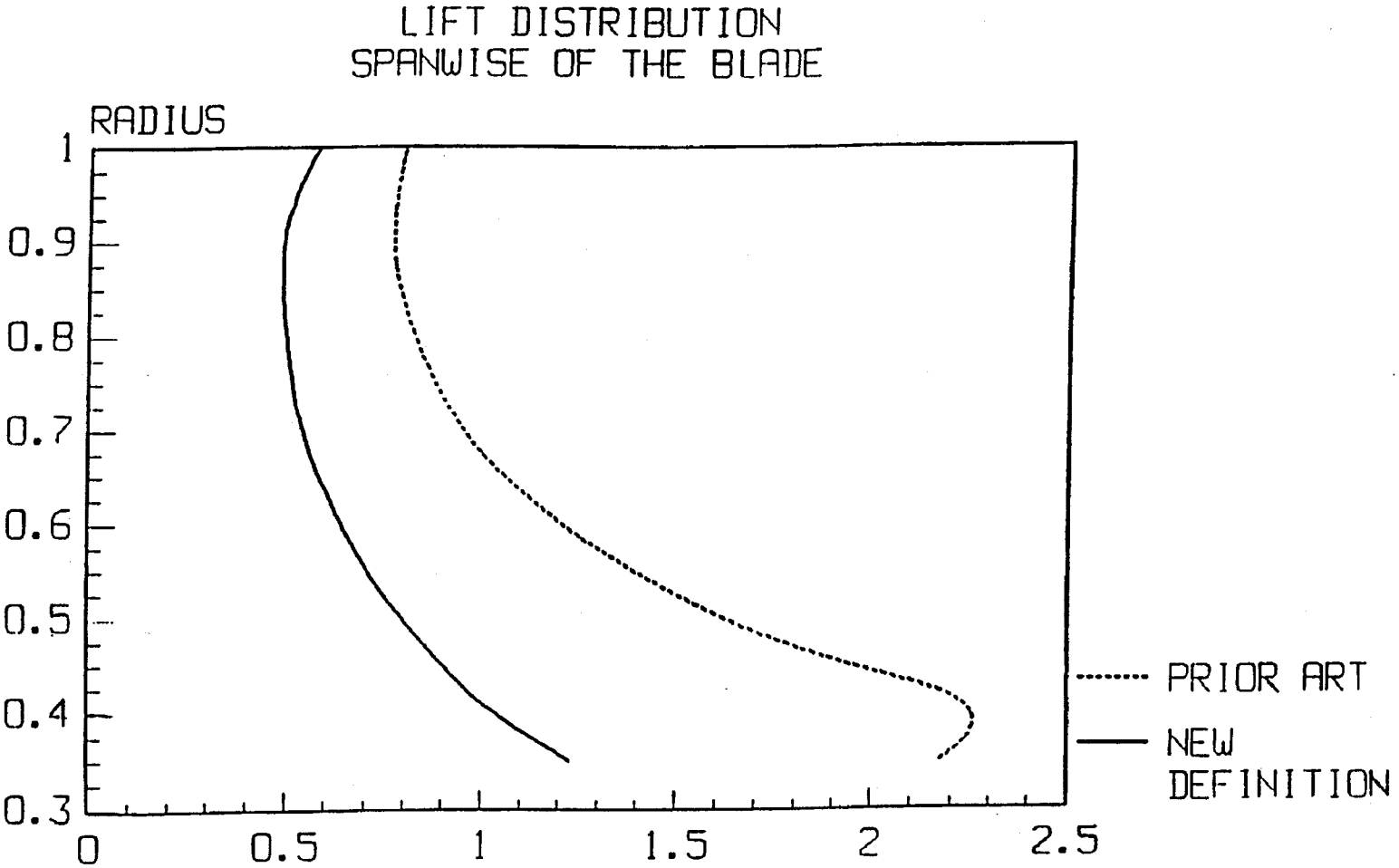
Figure 12:
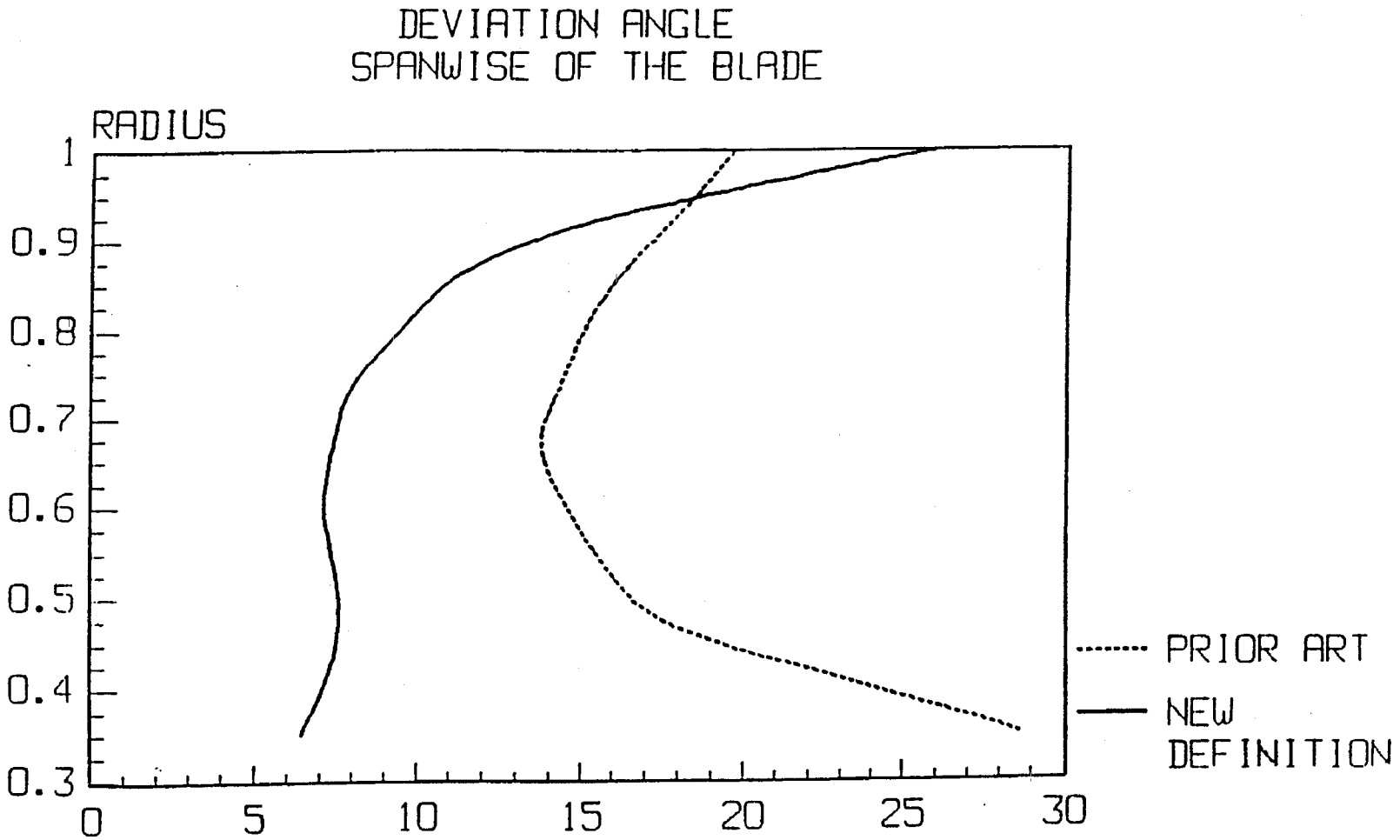

Referring to FIG. 11, the lift of the blade across the span is reduced and does not exhibit the point of inflection of a conventional blade. Turning to FIG. 12, the deviation angle is more smooth and uniform up to about 75% of the span. In the remaining span, the deviation angle abruptly rises to allow for the higher workload in the tip zone.

Figure 13:
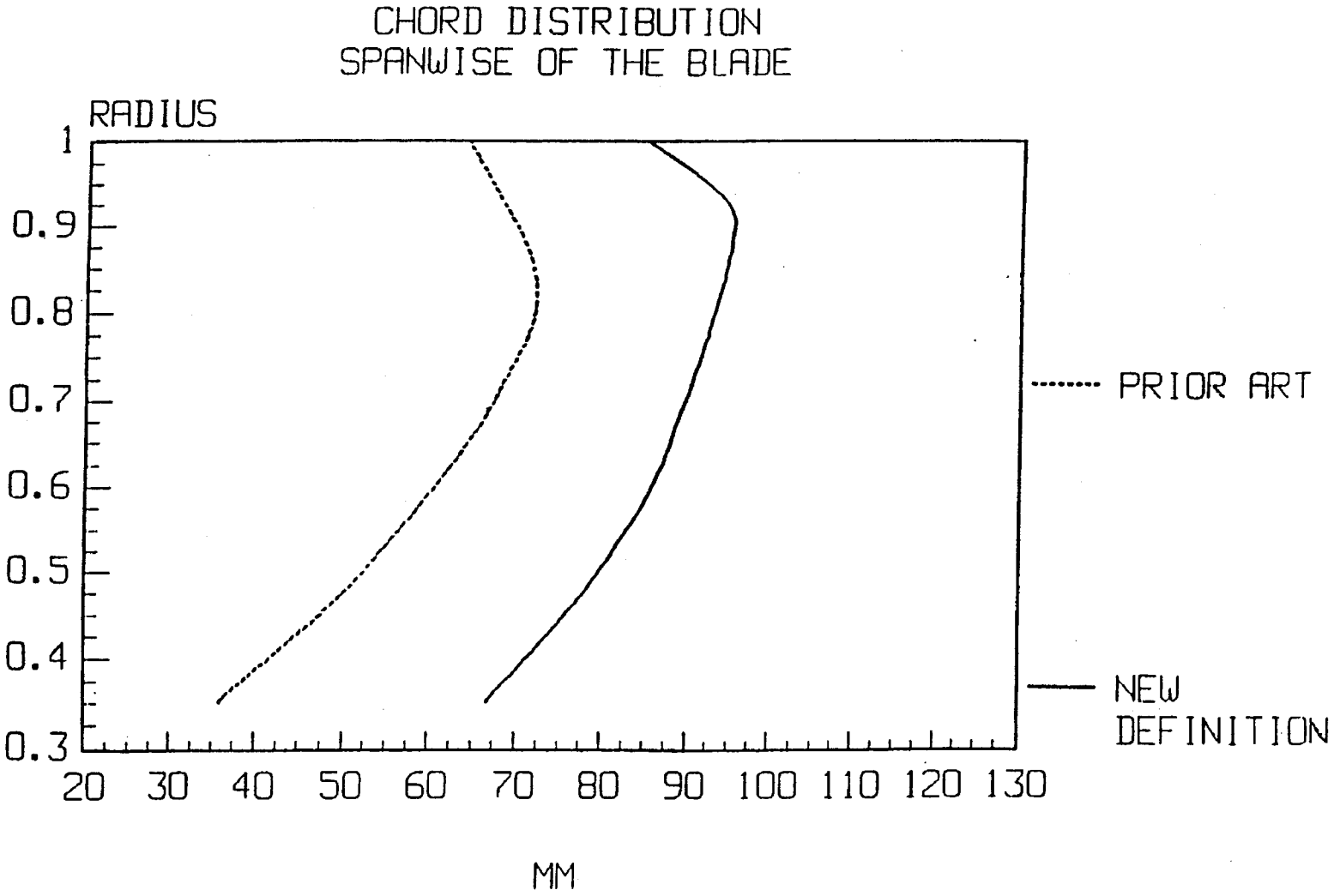
Figure 14:
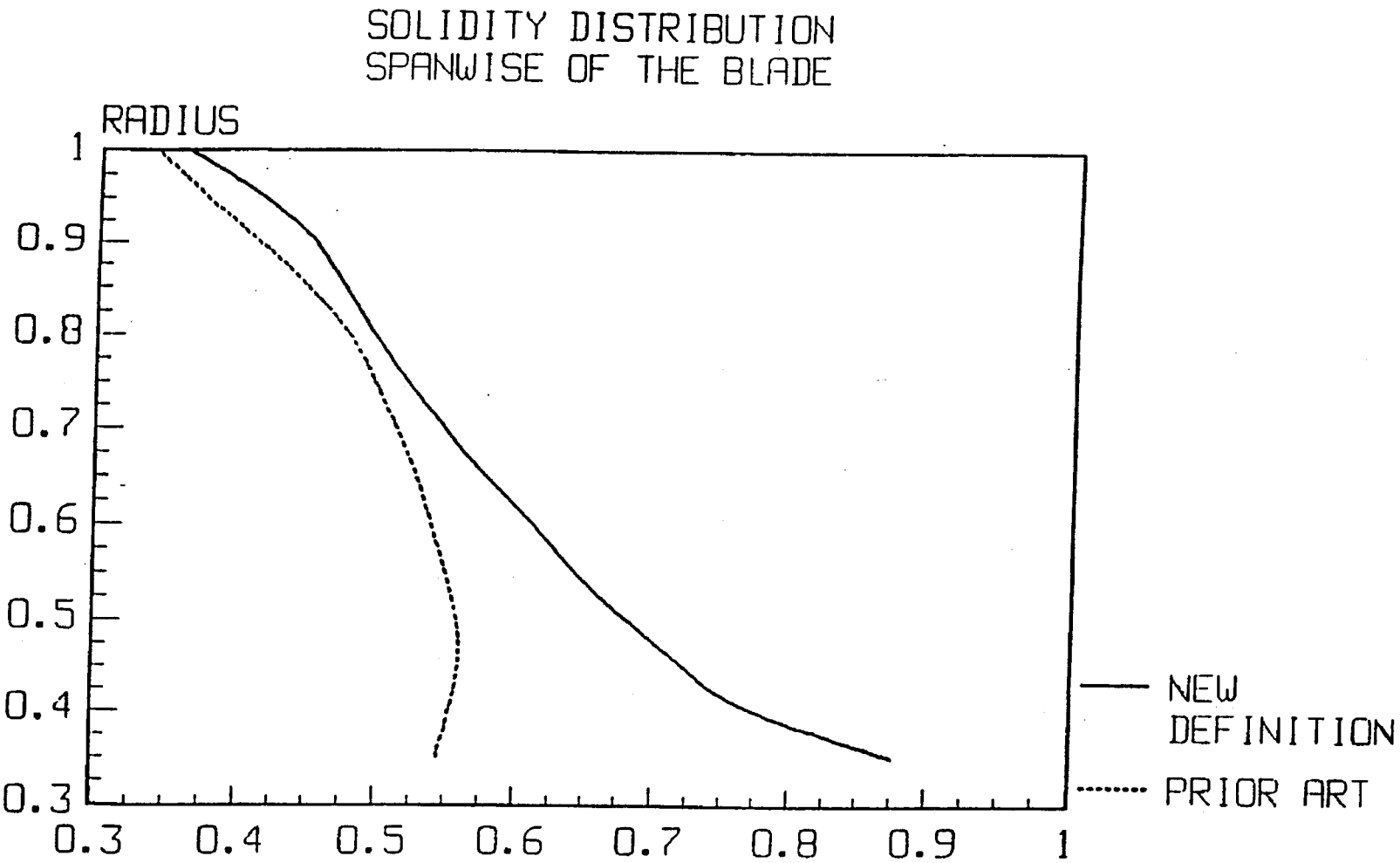
Figure 15:
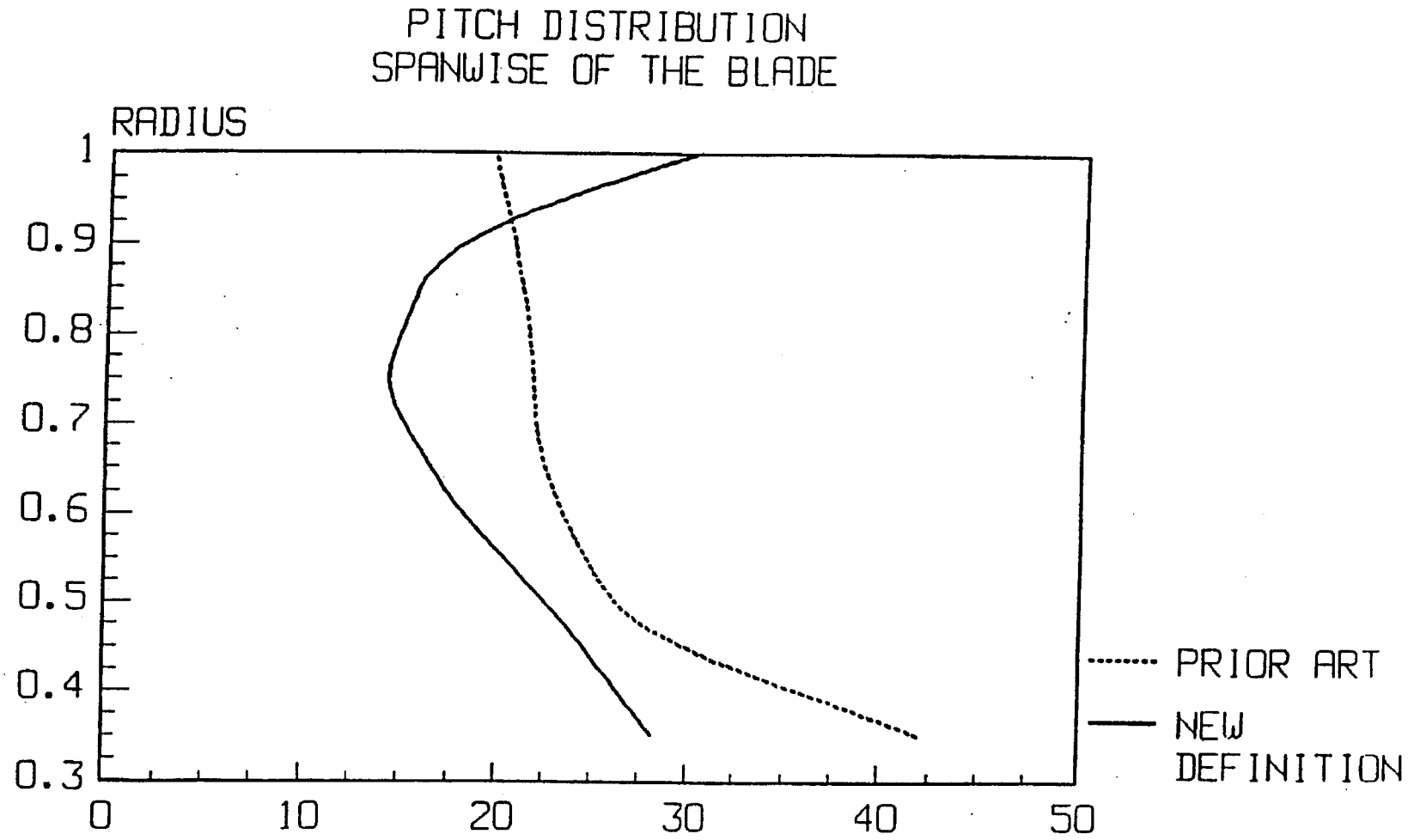
Figure 16:
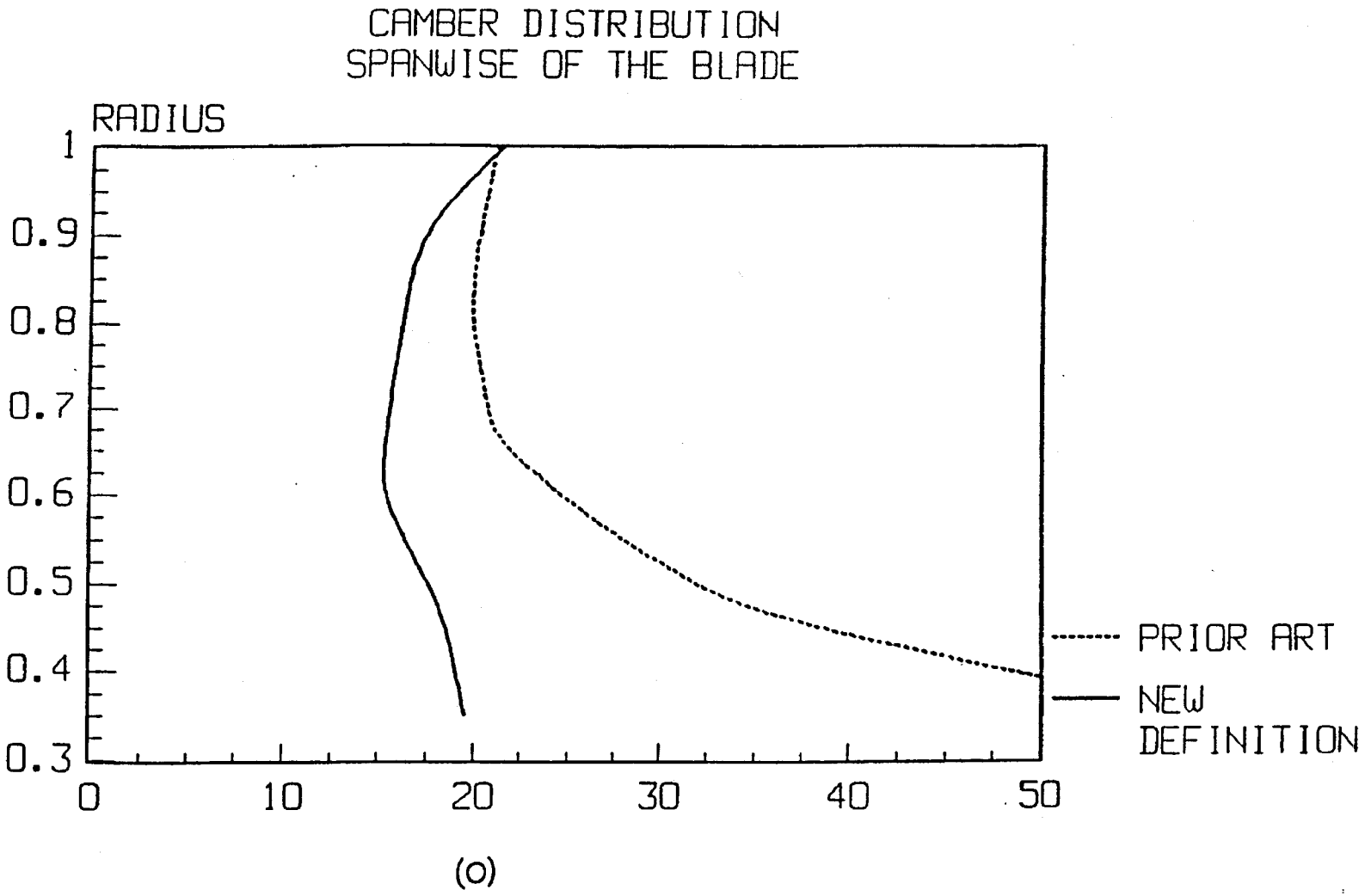

FIG. 13 shows that the chord length is increased along the blade radius of the fan, which gives rise to improved performance. Turning to FIG. 14, the solidity distribution, in other words the ratio of the blade chord to the sum of the blade chord and blade spacing is increased in the embodiment over the prior art. FIG. 15 shows the pitch distribution along the blade and FIG. 16 shows the camber distribution along the blade.

Figure 17:
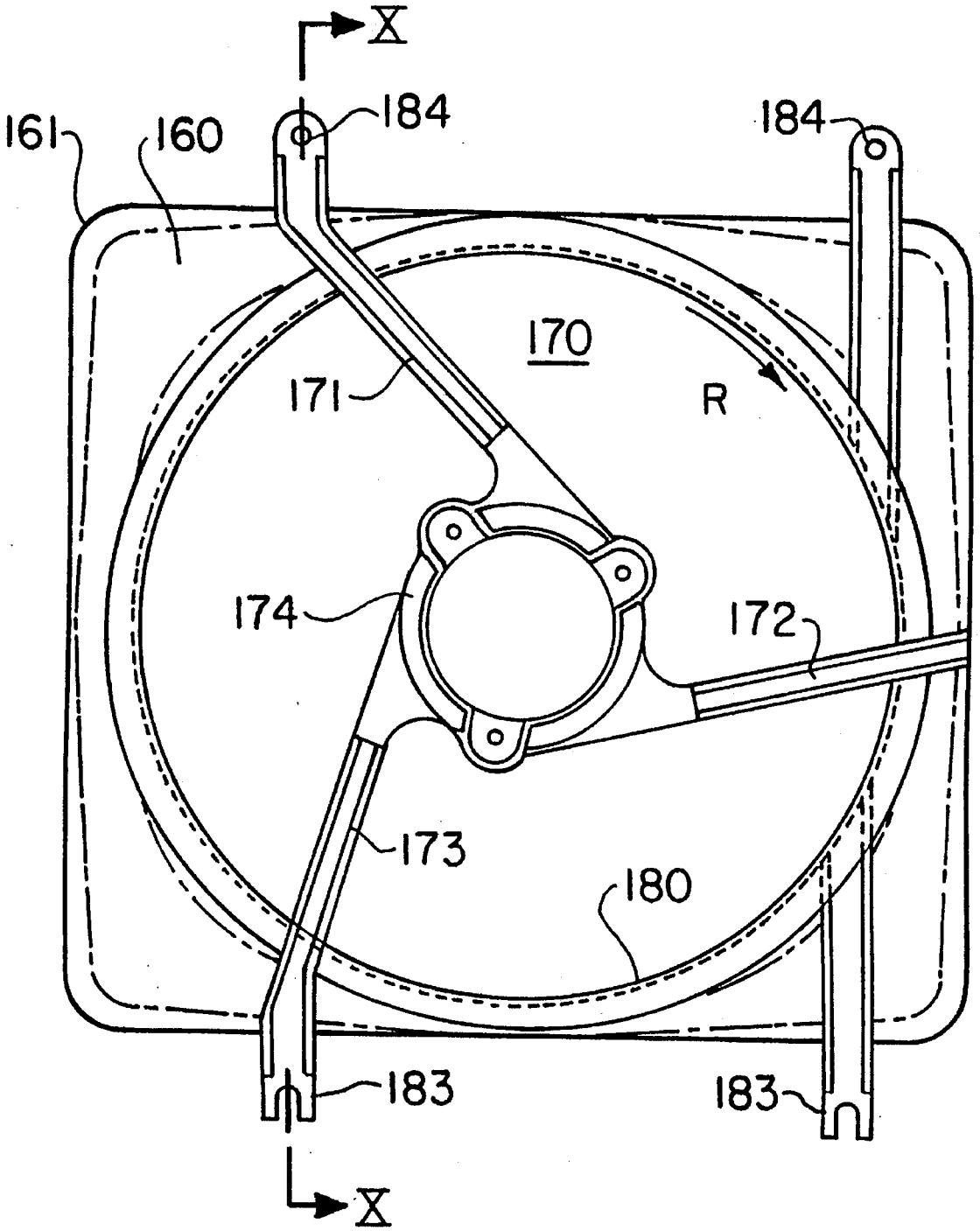
FIG. 17 shows a partial diagram of a fan mounting arrangement.
Figure 18:
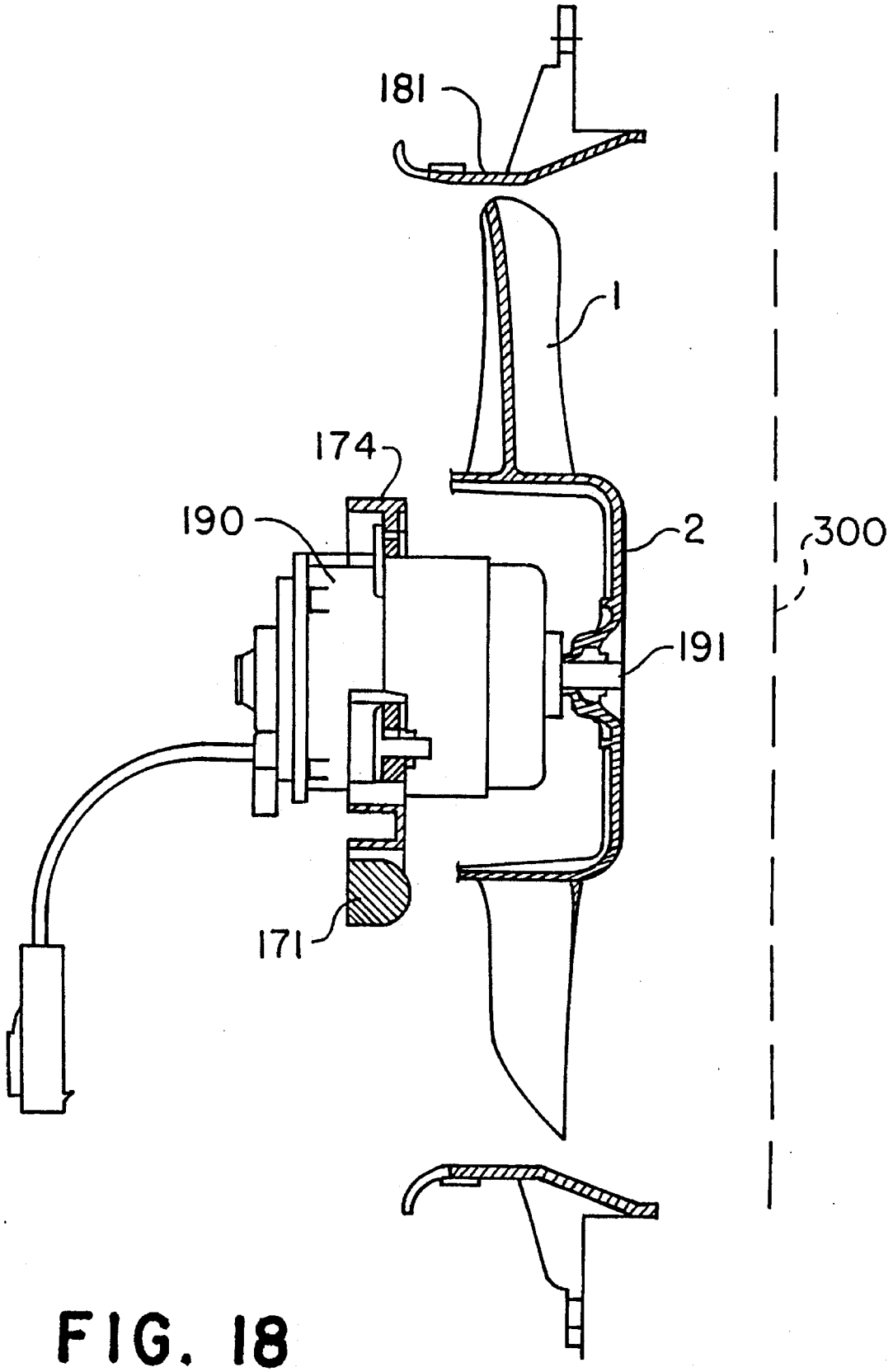
FIG. 18 shows a cross-sectional view through the fan mounting arrangement of FIG. 17, taken along lines X—X' of FIG. 17.
Figure 19:
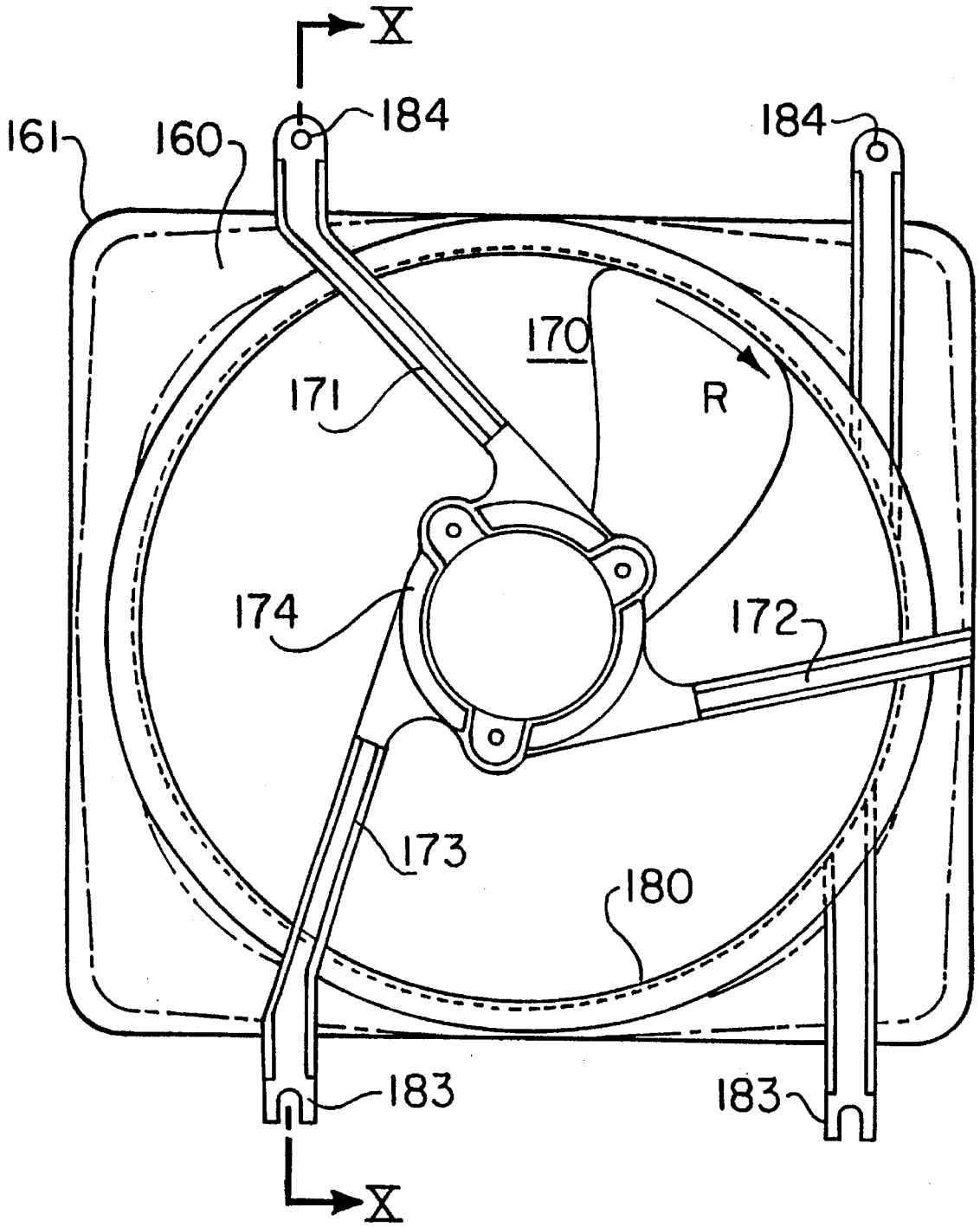
FIG. 19 shows a plan view of a rearwardly skewed fan blade in accordance with the invention.
Figure 20:
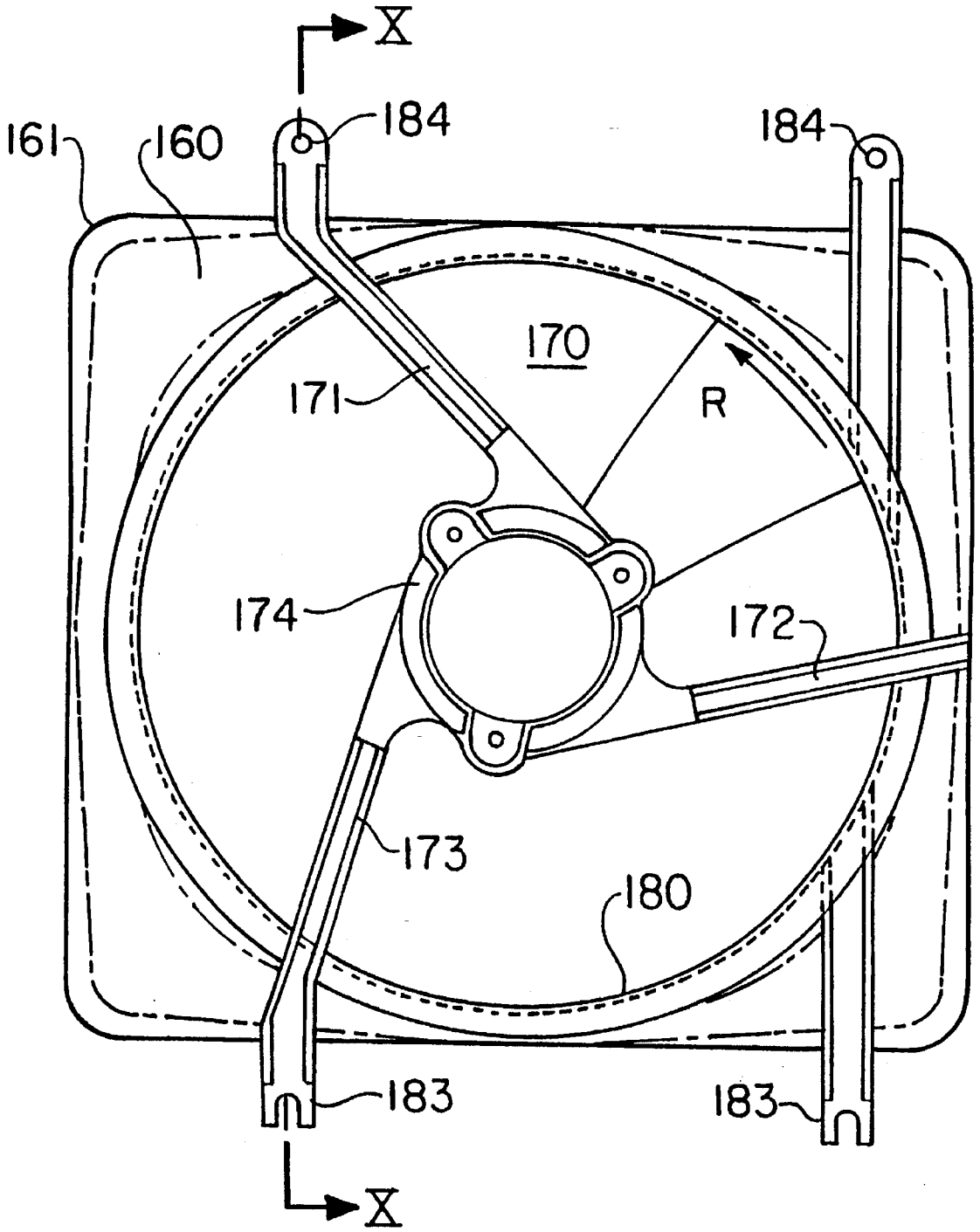
FIG. 20 shows a plan view of an unskewed fan blade in accordance with the invention.

Referring to FIGS. 17 and 18, a support structure and shroud for a fan of the invention is shown. The shroud (160) defines a circular aperture (170) and the fan is supported within the aperture by three arms (171,172,173) which extend generally radially inwardly from the outer periphery of the circular aperture (170) to a generally circular support portion (174). This support structure (174) supports an electric motor (190 in FIG. 18) having a shaft (191) to which is mounted the hub portion (2) of the fan. The fan rotates in the direction R. As has been previously mentioned, for optimum acoustic performance a prime number of blades 1 is chosen, typically 5 or 7 blades. To prevent acoustic coincidence between the blades and the support arms (171, 172,173), a different prime number of support arms—in the present case 3—is selected. To further improve the acoustic properties, the arms (171,172,173) are skewed in the opposite direction to the skew of the blade. Thus, each of the arms (171,172,173) extends not only radially with respect to the circular aperture (170), but also tangentially rearwardly with respect to the direction R of rotation of the fan. Where the fan blades have a rearward skew with respect to the direction of rotation thereof it is desirable to provide a forward skew to the support arms. Alternatively, where unskewed blades are provided, the support arms are skewed.

Referring now to FIG. 18, the circular aperture (170) is defined by a wall member (180). As has been previously described, the leading edge of the fan blades is swept upwardly with respect to a plane through the rear of the hub and the trailing edge is swept downwardly towards that plane. Thus, the tip region of the blades extends between 2 axially-spaced locations, and to provide effective air guidance the wall member (180) has a cylindrical portion (181) extending beside and along the axial extent of the tip of the blades. The wall member (180) curves radially outwardly to either side of this cylindrical region (181) to afford a smooth air passage on both sides of the fan, guiding the air flow and reducing turbulence effects. Reduced turbulence causes less overall noise, as is desired.

In a motor vehicle cooling system, the fan acts to draw air through an associated heat exchanger 300 (FIG. 18), or to push air through that heat exchanger. The shroud (160) accordingly extends outwardly into close proximity with a face portion of the heat exchanger to provide air flow guidance. The shroud (160) has a peripheral region (161) which is axially spaced from the wall member (180) defining the circular aperture (180). As seen in FIG. 18, the peripheral region is generally rectangular or square, having rounded corners.

As is known to one skilled in the art, the peripheral region (161) is disposed proximate to the associated heat exchanger face. The support structure and shroud are secured, either to the associated heat exchanger or to the structure of the vehicle adjacent thereto, by support portions (183,184), of which referring to FIG. 17, it will be seen that support portions (183) are provided with open-ended spade-type ends whereas support portions (184) are provided with securing holes.

What is claimed is:

1. An axial flow fan having plural blades secured to a hub portion, the hub having an axis of rotation and a back plane that is perpendicular to the axis of rotation, each blade having a leading edge, a trailing edge and a radially inner region extending to a tip region, wherein the leading and trailing edges that bound the radially inner region are in general radial alignment with the hub, the leading portion of the tip region is swept relative to the radially inner region in a first direction with respect to the back plane that is perpendicular to the axis of rotation of the fan and a trailing portion of the tip region is swept relative to the radially inner region in a second opposite direction with respect to said plane.

2. An axial flow fan as claimed in claim 1 wherein the leading portion of the tip region is swept in a first direction to form an acute angle with the back plane so as to be relatively further from said plane than the leading edge of radially inner region.

3. An axial flow fan according to claims 1 or 2 wherein each of said blades has a respective medial line that extends from the hub to the tip region, the medial line being equidistant from the leading and trailing edges of the individual blade, the sweep of the tip region relative to the back plane being neutral at the medial line of the tip region.

4. An axial flow fan having plural blades secured to a hub portion, the hub having an axis of rotation and a back plane that is perpendicular to the axis of rotation, each blade having a leading edge, a trailing edge and a radially inner region extending to a tip region, comprising a leading portion of the tip region swept relative to the radially inner region in a first direction with respect to the back plane that is perpendicular to the axis of rotation of the fan and a trailing portion of the tip region swept relative to the radially inner region in a second opposite direction with respect to said plane, wherein the radially inner region has an arc shaped cross-section, taken along a blade circumferential line, such that the bending ratio, defined as ratio of the maximum deviation from the chord at said circumferential line to the length of the chord, decreases over the radially innermost portion of the radially inner region of each blade, and then increases over a radially adjacent portion of the radially inner region.

5. An axial flow fan as claimed in claim 4 wherein the bending ratio varies along the span of the radially inner region substantially symmetrically about a radial mid-point of the radially inner region.

6. An axial flow fan as claimed in claim 5 wherein the bending ratio in the radially inner region is lowest at the mid point.

7. An axial flow fan as claimed in any one of claims 4–6, wherein the maximum value of bending ratio along the total blade span is 4% or less.

8. An axial flow fan according to claim 4 wherein the leading edge of the radially inner region is more distant from said plane than the trailing edge of said region.

9. An axial flow fan according to claim 4 wherein there is provided a prime number of blades.

10. An axial flow fan according to claim 4 in combination with a fan shroud member defining a substantially circular aperture and a fan motor support portion for mounting the fan within the circular aperture, the fan motor support portion comprising a prime number of arm members extending from the shroud member into the circular aperture.

11. The combination according to claim 10 further comprising a fan motor for driving the axial flow fan, and the plural arm members are secured to a fan motor support portion, the fan motor support portion being disposed substantially concentrically with the circular aperture.

12. The combination according to claim 10 or claim 11 wherein the shroud member has a substantially planar external peripheral portion for disposition proximate a heat exchanger.

13. The combination according to claims 10 or 11 wherein the arm members extend non-radially into the circular aperture.

14. The combination of claim 13 wherein each of the arm members is skewed in the same sense with respect to a respective radius.

15. The combination of claim 14 wherein the leading portion of the tip region of each blade of the fan is forwardly skewed with respect to the direction of rotation of the fan and the arms are rearwardly skewed with respect to the direction of rotation of the fan.

16. The combination of claim 14 wherein the leading portion of the tip region of each blade of the fan is rearwardly skewed with respect to the direction of rotation of the fan and the arm members are each forwardly skewed with respect to the direction of rotation of the fan.

17. The combination of claim 14 wherein each blade is unskewed with respect to the direction of rotation of the fan.

* * * * *